United States Patent [19]

Kroontje et al.

[11] Patent Number: 4,588,919

[45] Date of Patent: May 13, 1986

[54] LOW-PRESSURE ALKALI METAL VAPOR DISCHARGE LAMP WITH ARC TUBE GETTERING

[75] Inventors: Wiggert Kroontje; Franciscus M. P. Oostvogels, both of Eindhoven, Netherlands

[73] Assignee: U.S. Philips Corporation, New York, N.Y.

[21] Appl. No.: 597,977

[22] Filed: Apr. 9, 1984

[30] Foreign Application Priority Data

Apr. 25, 1983 [NL] Netherlands ..... 8301447

[51] Int. Cl.[4] ..... H01J 61/22; H01J 61/26; H01J 61/34

[52] U.S. Cl. ..... 313/25; 313/558; 313/562; 313/638

[58] Field of Search ..... 313/25, 553, 558, 559, 313/561, 562, 638; 417/48, 51

[56] References Cited

U.S. PATENT DOCUMENTS

| | | | |
|---|---|---|---|
| 4,117,369 | 9/1978 | Kuus et al. | 313/558 X |
| 4,277,717 | 7/1981 | Van Benthem et al. | 313/634 |
| 4,380,714 | 4/1983 | Bouman et al. | 313/559 X |
| 4,461,981 | 7/1984 | Saikatsu et al. | 313/558 X |

*Primary Examiner*—David K. Moore
*Assistant Examiner*—K. Wieder
*Attorney, Agent, or Firm*—David R. Treacy

[57] ABSTRACT

A low-pressure alkali metal vapor discharge lamp has a getter for bi- and triatomic gases and a getter holder in the arc tube near at least one electrode. The electrodes need be heated less strongly during evacuation of the prior to final dosing, as a result of which no emitter material of the electrodes is lost. The ignition voltage is considerably lower than that of conventional lamps without a getter.

2 Claims, 1 Drawing Figure

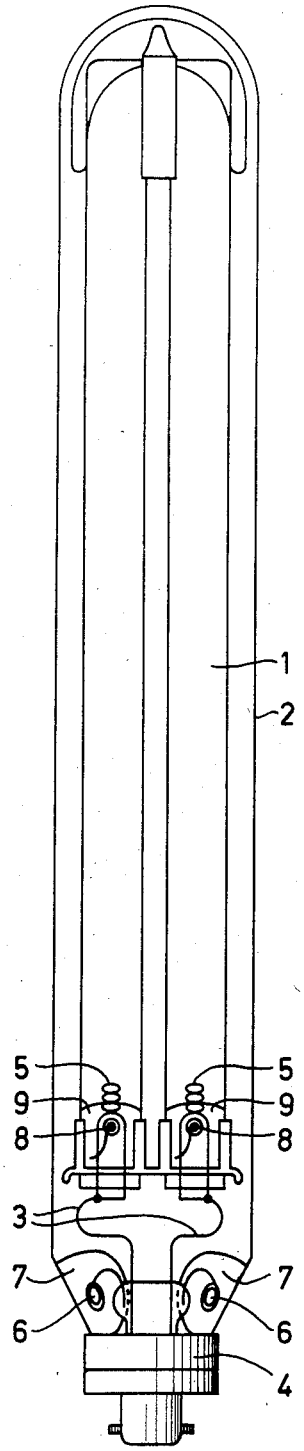
1
2
5
5
9
9
8
8
3
7
7
6
6
4

LOW-PRESSURE ALKALI METAL VAPOR DISCHARGE LAMP WITH ARC TUBE GETTERING

BACKGROUND OF THE INVENTION

The invention relates to a low-pressure alkali metal vapor discharge lamp provided with a discharge envelope or arc tube which is arranged in an evacuated outer bulb, electrodes arranged in the arc tube and incorporating an emitter containing an alkaline earth metal oxide, and a getter in the evacuated space. As used hereinafter, an alkali metal vapor discharge lamp refers to one in which, in an operating condition, the arc discharge current is carried primarily by an alkali metal vapor rather than by an inert gas. A low-pressure sodium vapor lamp of this kind is known from German Pat. No. 913,468.

The known lamp has a gettering metal layer deposited on a wall in the evacuated space between the outer bulb and the discharge envelope. This gettering metal layer serves to bind residual gases and gases released during the life of the lamp. Thus a high vacuum is maintained which minimises thermal losses which would otherwise result from heat conduction by these gases. Examples of such gases are: hydrogen, oxygen, nitrogen, water vapour, carbon monoxide and carbon dioxide.

The gettering metal layer may consist of a metal, such as barium, calcium, strontium, or magnesium. The metal layer is obtained by heating an open holder provided with such a metal after the outer bulb has been evacuated, as a result of which the metal evaporates for the major part and is deposited on a wall opposite to the opening of the holder.

In general, the getter metal is present in the holder in the form of an alloy with, for example, aluminum. In this form, the gettering metal can be manipulated more readily in air. The alloy can be mixed with a metal powder, such as nickel, iron, titanium or thorium powder, for example with an equal quantity by weight of such a powder. Such a powder enters into an exothermal reaction with the alloy upon heating, as a result of which the getter metal is released and evaporated more rapidly. Mostly, a part of the gettering metal remains in the holder, generally as a compound with, for example, oxygen or with the metal with which the getter metal was provided as an alloy.

Otherwise, a holder with a non-evaporating getter, for example, a metal strip coated with zirconium aluminium or zirconium nickel, may be present in the evacuated space.

Before the discharge envelope is sealed, this envelope is evacuated, while the electrodes are heated in order to release absorbed gases therefrom. Carbon dioxide may be produced at this time if the emitter is provided on or in the electrode in the form of one or more carbonates, or water may be produced if the emitter is provided in the form of a hydroxide. Subsequently, the discharge envelope is provided with its gas filling and sealed.

It has been found that during their heating the electrodes lose a part of the quantity of emitter, which deposits on the wall of the discharge envelope. This loss of a part of the supply of emitter of the electrodes is contrary to the endeavours made to furnish the electrodes with as large a quantity of emitter as possible, in order to prevent the lack of emitter from curtailing the life of a lamp.

It has further been found that lamps have a higher ignition voltage if the electrodes are heated during the manufacturing process only to a temperature at which just no loss of emitter occurs.

An example of a getter-like action in an alkali metal arc tube is shown in British Pat. No. 2,007,423, which describes a low-pressure sodium vapor discharge lamp which contains in the arc tube a substance which binds potassium. This substance, sodium iodide, is not so much a getter as an ion exchanger. Potassium, which is released from the wall of the discharge vessel, enters into a displacement reaction with this substance, in which the sodium ion from the iodide is replaced by a potassium ion and sodium is released ($NaI+K \rightarrow KI+Na$).

SUMMARY OF THE INVENTION

The invention has for its object to provide a low-pressure alkali metal vapor discharge lamp which ignites at a comparatively low voltage, at the same time that any loss of emitter material of the electrodes is effectively avoided.

According to the invention, in a low-pressure alkali metal vapor discharge lamp a getter for di- and triatomic gases, such as $H_2$, $O_2$, $N_2$, $H_2O$, CO and $CO_2$, and a getter holder are arranged in the discharge envelope.

The getter may be provided in the discharge envelope in a form which is common practice for use in the outer bulb; namely an open holder provided with the getter, with an alloy of the getter, or with an alloy of the getter mixed with a metal powder which enters into an exothermal reaction with the alloy. Alternatively, a holder with a non-evaporating getter may be used.

During the manufacture of the lamp, the discharge envelope is evacuated and the electrodes are heated in order to desorb gases therefrom and, as the case may be, to form the emitter from, for example, one or more carbonates and/or one or more hydroxides. When the discharge envelope is freed to a large extent from impurities, the filling is provided and the discharge envelope is sealed. In the case an evaporating getter is present, when a discharge is produced for the first time in the discharge envelope, the getter metal can evaporate for the major part from its holder and deposit opposite to the holder on the inner side of the wall of the discharge envelope. In the case a non-evaporating getter is present, this getter is activated as impurities at the getter surface difuse inwards due to the heating of the getter by the energy dissipated in the envelope. It is alternatively possible, however, to heat the getter holder inductively and consequently to evaporate and to activate the getter, respectively.

The getter holder, for example an open annular getter or a metal strip, can be arranged in the proximity of an electrode, for example secured to a current-supply conductor to an electrode. In a preferred embodiment, the getter holder is situated in an electrode chamber. The holder then reaches a comparatively high temperature during operation, as a result of which the getter can be caused to be evaporated or activated. The holder of an evaporating getter can then be so directed that the deposition of the getter metal on the wall of the discharge envelope does not hinder the emanation of the light generated during operation. The use of an evaporating getter, such as barium, has the advantage of a getter of high reactivity and a large reactive surface area.

In comparative experiments with low-pressure sodium vapor discharge lamps which consumed 35 W during operation, the following has been found. Three series of lamps were manufactured: In a first series of lamps, the electrodes were heated stepwise to approximately 1150° C. after the discharge envelope had been evacuated. No deposition of emitter material on the wall of the discharge envelope was then found. Subsequently, the discharge envelope was provided with its gas filling and, after being mounted in an outer bulb, processed to a finished lamp.

In a second series of lamps, on the contrary, the electrodes were heated to approximately 1250° C., whereby deposition of emitter material on the wall of the discharge envelope was found.

In a third series of lamps, the electrodes were heated in the same manner as the electrodes of the first series. In the discharge envelope, near each of the electrodes, there was mounted an open annular holder filled with 4.5 mg of a mixture of equal parts by weight of $BaAl_4$ and nickel. After the discharge envelope had been sealed, the getter holder was heated inductively and the getter metal evaporated, so that this metal deposited opposite the opening of the holder on the wall of the discharge envelope.

The lamps of the second and the third series were otherwise identical to those of the first series.

Across the lamps there was applied a voltage which was increased stepwise by 20 V until the lamps ignited. The lamps of the first series ignited only at 620 V, those of the second series at 580 V and those of the third series at 420 V. It is advantageous that the lamps according to the invention ignite at a relatively low voltage because this results in less emitter consumption. Further, the risk of incidental reject due to an excessively high ignition voltage is thus reduced. These advantages are not reduced by the fact that the ignition voltage of the lamps of the first two series decreases with an increasing number of operating hours and finally becomes equal to that of lamps according to the invention.

BRIEF DESCRIPTION OF THE DRAWING

An embodiment of a lamp according to the invention is shown in the drawing in side elevation.

DESCRIPTION OF THE PREFERRED EMBODIMENT

In the drawing, a discharge envelope or arc tube 2 provided with an ionizable-metal-vapor-containing gas filling is arranged in an evacuated outer bulb 2. Current-supply conductors 3 extend from a lamp cap 4 through the wall of the discharge envelope 1 to electrodes 5 arranged in the discharge envelope. The outer bulb 2 accommodates holders 6 from which a gettering metal layer 7 is deposited on the wall of the outer bulb.

Near each of the electrodes a respective open holder 8 is mounted in the discharge envelope and a gettering metal layer deposited on the wall of the discharge envelope 1 is situated opposite to this holder.

The lamp shown is a 35 W low-pressure sodium lamp with a gas filling of approximately 450 mg of Na and a mixture of 99% by volume of neon and 1% by volume of argon at a pressure of 1200 Pa. The electrodes have an emitter comprising a mixture of equimolar quantities of BaO, CaO, and SrO obtained from 22 mg of a corresponding mixture of carbonates. The open holders 6 and 8 are annular getters from which barium has evaporated. This getter material has deposited as layers 7 and 9, respectively, on the wall of the outer bulb 2 and of the discharge envelope 1, respectively. The holders contain a residue of mainly aluminum-nickel, and a small quantity of barium compound.

What is claimed is:

1. A low-pressure alkali metal vapor discharge lamp, comprising an evacuated outer bulb; a discharge envelope arranged in said bulb; electrodes arranged in the discharge envelope for establishing an arc discharge path during operation of the lamp, said electrodes including an emitter comprising an alkaline earth metal oxide; current-supply conductors extending through a wall of said outer bulb and a wall of said discharge envelope to said electrodes; and a filling, contained in said envelope, comprising an inert gas and an ionizable alkali metal, in an operating condition of the lamp the arc discharge being carried primarily by alkali metal vapor, characterized by comprising a getter holder and a getter for bi- and triatomic gases arranged in said envelope to achieve reduction in lamp starting voltage.

2. A lamp as claimed in claim 1, characterized in that said getter holder is an open holder having an opening, mounted near one of said electrodes, and in that a gettering metal layer is disposed in said envelope opposite said opening.

* * * * *